US006765354B2

(12) United States Patent
Klien et al.

(10) Patent No.: US 6,765,354 B2
(45) Date of Patent: Jul. 20, 2004

(54) CIRCUITRY ARRANGEMENT FOR THE OPERATION OF A PLURALITY OF GAS DISCHARGE LAMPS

(75) Inventors: Dietmar Klien, Mäder (AT); Markus Mayrhofer, Dornbirn (AT)

(73) Assignee: TridonicAtco GmbH & Co. KG, Dornbirn (AT)

( * ) Notice: Subject to any disclaimer, the term of this patent is extended or adjusted under 35 U.S.C. 154(b) by 0 days.

(21) Appl. No.: 10/408,248

(22) Filed: Apr. 8, 2003

(65) Prior Publication Data

US 2003/0214252 A1 Nov. 20, 2003

Related U.S. Application Data

(63) Continuation of application No. PCT/EP01/11073, filed on Sep. 25, 2001.

(30) Foreign Application Priority Data

Oct. 9, 2000 (DE) ..... 100 49 842

(51) Int. Cl.[7] ..... H05B 37/02
(52) U.S. Cl. ..... 315/291; 315/224; 315/297
(58) Field of Search ..... 315/291, 224, 315/294, 297, 277, 276, 312

(56) References Cited

U.S. PATENT DOCUMENTS 4,438,372 A * 3/1984 Zuchtriegel ..... 315/224
5,173,643 A 12/1992 Sullivan et al. ..... 315/276
5,729,095 A 3/1998 Shimokawa et al. ..... 315/176
6,310,444 B1 * 10/2001 Chang ..... 315/291
6,674,246 B2 * 1/2004 Moisin ..... 315/224

FOREIGN PATENT DOCUMENTS

| | | |
|---|---|---|
| DE | 4243955 A1 | 6/1994 |
| EP | 0490329 A1 | 6/1992 |
| EP | 0547674 A1 | 6/1993 |
| EP | 0676121 A1 | 10/1995 |
| EP | 0490329 B1 | 4/1996 |
| WO | WO00/54558 | 9/2000 |

* cited by examiner

*Primary Examiner*—Don Wong
*Assistant Examiner*—Ephrem Alemu
(74) *Attorney, Agent, or Firm*—Fitzpatrick, Cella, Harper & Scinto

(57) ABSTRACT

A circuitry arrangement for operating n gas discharge lamps, n being a whole number greater than 1, includes a single inverter, fed with d.c. voltage, for generating an a.c. voltage alterable in its frequency, delivered to a load circuit arranged at the inverter's output. The load circuit includes a series resonant circuit of an inductance and capacitance, n gas discharge lamps connected to a common node point between the inductance and capacitance, which lamps are connected in parallel to one another, and (n−1) balancing transformers for balancing currents in two gas discharge lamps. The load circuit further has for each gas discharge lamp at least one d.c. current supply line, connected between an output side terminal of a corresponding balancing transformer winding and gas discharge lamp and via which there is delivered to each gas discharge lamp a d.c. current, so as to avoid an unintended extinguishing of a lamp.

9 Claims, 4 Drawing Sheets

CIRCUITRY ARRANGEMENT FOR THE OPERATION OF A PLURALITY OF GAS DISCHARGE LAMPS

CROSS REFERENCE TO RELATED APPLICATIONS

This is a Continuation of International Application PCT/EP01/11073 filed Sep. 25, 2001 which in turn claims priority of German application DE 100 49 842.6 filed Oct. 9, 2000, the priorities of which are hereby claimed, said International Application having been published in German, but not in English, as WO 02/32196 A1 on Apr. 18, 2002. International Application PCT/EP01/11073 is incorporated by reference herein in its entirety, as if fully set forth herein.

BACKGROUND OF THE INVENTION

1. Field of the Invention

The present invention relates to a circuitry arrangement for the operation of at least two gas discharge lamps.

2. Description of the Related Art

Through the employment of so called double-lamp or multiple-lamp ballasts to a certain extent a reduction of the outlay in terms of circuitry can be achieved. The advantage in comparison with the employment of ballasts which in each case control only a single gas discharge lamp consists in that a greater part of the components of the ballast, for example the rectifier, the harmonics filter, the control circuit and the inverter, can be simultaneously employed for the operation of a plurality of lamps.

The inverter and the load circuit of a known double-lamp ballast, which is disclosed in EP 0 490 329 A1, are schematically illustrated in FIG. 4 and will be briefly explained below. The inverter is formed by means of two controllable switches S1 and S2 which are arranged in a half-bridge arrangement to the input of which a supply d.c. voltage $V_{BUS}$ is applied. The two switches S1 and S2 are so controlled by a control circuit 1 that they alternatingly open and close so that at the middle point of the half-bridge there is yielded a high frequency a.c. voltage $U_{ac}$. This a. c. voltage is delivered to the load circuit, which initially on the input side has a series resonant circuit of an inductance $L_a$ and a capacitance $C_r$. To the common node point between the inductance $L_a$ and the capacitance $C_r$, the two gas discharge lamps LA1 and LA2 are connected in parallel in each case via a coupling capacitor $C_{k1}$ and $C_{k2}$.

Further, there is connected upstream of two gas discharge lamps LA1 and LA2 a balancing transformer $L_{bal}$, the windings of which are flowed through by the two lamp currents. This happens in opposite senses so that upon deviations of the current amplitudes a magnetization arises which induces a voltage in the windings, which in turn works in a balancing manner. By means of the balancing transformer $L_{bal}$ component tolerances and lamp tolerances, and different temperature conditions, which could have the consequence that the two lamps LA1 and LA2 burn with different brightnesses, can be compensated to a certain degree.

The balancing effect of the transformer $L_{bal}$ is however restricted and does not ensure a complete equalization of the lamp currents. For example at low currents, which occur with small dimming levels, the lamps are practically parallel connected, since the voltage drop at the balancing transformer can amount only to a fraction of the arc drop voltage of the lamps. This is manifest particularly at lower temperatures, where the arc drop voltage at small lamp currents reaches a maximum.

This case is illustrated in FIG. 5. Thereby, the two lamps are to be operated at a brightness which corresponds to a certain desired current $I_{SOLL}$. However, due to tolerances, the two lamps are not identical but manifest characteristic lines $U_{arc1}$ and $U_{arc2}$ which are slightly displaced with respect to one another, as they are illustrated in FIG. 5. Thus, for example, with a predetermined current, the second lamp requires in principle a somewhat greater arc drop voltage $U_{arc2}$ than the first lamp. In order then to be able to operate both lamps with the desired current, $I_{SOLL}$, two different arc drop voltages $U_{SOLL1}$ and $U_{SOLL2}$ would be necessary. Since, however, the ballast with the inverter makes available only one voltage value $U_{SOLL1}$, which in the illustrated example is determined by the lamp having the lower arc drop voltage, that is by the first lamp having the characteristic line $U_{arc1}$, this voltage $U_{SOLL1}$ is also applied to the second lamp. As a consequence thereof the second lamp does not take up the desired current value $I_{SOLL}$ but possibly forms a second working point with a different current value $I_{arc2}$ and therewith naturally also has a different brightness. There exists, however, also the danger that the second lamp having the higher arc drop voltage possibly may be able to find no fixed working point and as a consequence extinguishes.

In order therefore, in the case of lower brightness values, to avoid the extinguishing of one of the two lamps LA1 or LA2, there is effected with the ballast illustrated in FIG. 4 the regulation of the inverter always in accordance with that lamp LA1 or LA2 which has the lower lamp current at the time. For this purpose, the ballast has two detection circuits $\mathbf{2}_1$ and $\mathbf{2}_2$ which in each case detect the current flowing through a lamp LA1 or LA2, in that they determined the voltage dropped across a measurement resistance $R_{SENS1}$ or $R_{SENS2}$. The actual values $V_{IST1}$ and $V_{IST2}$ generated by the two detection circuits $\mathbf{2}_1$ and $\mathbf{2}_2$ are then delivered to a comparator circuit 3 which selects the corresponding lower value and passes this as the final actual value $V_{IST}$ to the control circuit 1 for the control of the inverter.

Thus, there is needed for each lamp its own detection circuit, in order to be able reliably to ensure that neither of the two lamps extinguishes. The outlay in terms of circuitry is, however, again increased through this. Further, it is to be taken into consideration that depending upon the switching capacitances of the lamps or the wiring, a capacitive current always also flows through the lamps. A satisfactory control is, however, only then ensured if the actual effective component of the lamp current is determined. For this purpose complex and expensive circuits are necessary. Finally with the multiple lamp systems, with which more than two lamps are connected to a single inverter, there is needed a complex selection circuit for selecting the lowest actual value in each case.

SUMMARY OF THE INVENTION

It is thus the object of the present invention to indicate a simplified circuitry arrangement for the operation of at least two gas discharge lamps, with which the extinguishing of one of the lamps can be reliably avoided.

This object is achieved by means of a circuitry arrangement in accordance with the present invention. In accordance with the invention, n (n is a whole number and greater than 1) gas discharge lamps are operated with a single inverter, which is supplied with a d.c. voltage and generates an a.c. voltage which is alterable in its frequency, which is delivered to a load circuit arrangement at the output of the inverter. Thereby, the load circuit includes a series resonant circuit of an inductance and a capacitance, and the n gas discharge lamps connected to the common node point between the inductance and the capacitance. Further, the load circuit contains (n−1) balancing transformers for the balancing of the currents of in each case two gas discharge lamps.

In order to prevent that one of the lamps extinguishes, in accordance with the invention the load circuit has for each gas discharge lamp a d.c. current supply line which in each case taps between the output side terminal of the winding of the balancing transformer and the gas discharge lamp and via which a d.c. current is delivered to each gas discharge lamp. Thus, each gas discharge lamp receives, along with the a.c. voltage delivered via the resonant circuit and the rectifier, additionally an independent current source which supplies the lamp with a d.c. current. This additional d.c. current corresponds advantageously approximately to the half of the nominal 1% current at 25° C. to 35° C. It has the effect that even for the case that due to the predetermined a.c. voltage no stable working point can develop, no lamp extinguishes. Beyond this, the additional d.c. current prevents the appearance of so-called running layers.

The d.c. current supply lines have preferably in each case a resistance connected in series with the lamp and are connected at their input side terminal to a common supply voltage. This supply voltage can be obtained for example with the aid of a diode connected to the output of the inverter, whereby preferably between the diode and the d.c. supply lines there is arranged a capacitor connected with ground.

Through the measures in accordance with the invention, the extinguishing of the lamps can be reliably prevented. However, due to asymmetrical wiring capacitances and lamp capacitances, great brightness differences can arise since the balancing transformer or transformers tend to equalize the relatively great currents and as a consequence in a lamp having lesser wiring capacitance an additional effective current is generated. In order to avoid this and to attain a better balancing of the lamp currents, in accordance with a further development of the invention the two windings of a balancing transformer can in each case be connected with one another by means of a series circuit of a capacitor and a resistance. This has the consequence that the balancing effect of the transformer is reduced for small lamp currents, without thereby the d.c. current sources being affected. The reduction of the balancing effect manifests itself solely on the a.c. current components of the lamp voltage, that is only on that part which at small dimming levels is substantially influenced by asymmetric wiring capacitances.

The circuitry in accordance with the invention distinguishes itself in that it can be expanded in simple manner from a double lamp system to a multiple lamp system. Further, it is no longer necessary to provide for each lamp its own detection circuit for the measurement of the lamp current. Rather, it is sufficient to employ solely a single detection circuit, which detects the sum of the effective powers of the gas discharge lamps arranged in the load circuit and generates a corresponding actual value. On the basis of a comparison between this actual value and a predetermined desired value, the inverter can then be controlled. The detection of the sum of the effective powers can, for example with a half-bridge rectifier, be effected in simple manner in that the voltage dropped across a measurement resistance arranged at the base point of the half-bridge is determined.

The d.c. supply lines proposed in accordance with the invention, with the resistances connected in series to the lamps, which are connected on the input side to a common supply voltage, can also be employed with multiple lamp lamp systems with which no balancing transformers are provided.

BRIEF DESCRIPTION OF THE DRAWINGS

The invention is described in greater detail with reference to the attached drawings.

DETAILED DESCRIPTION OF THE PREFERRED EMBODIMENT

Figure 1:
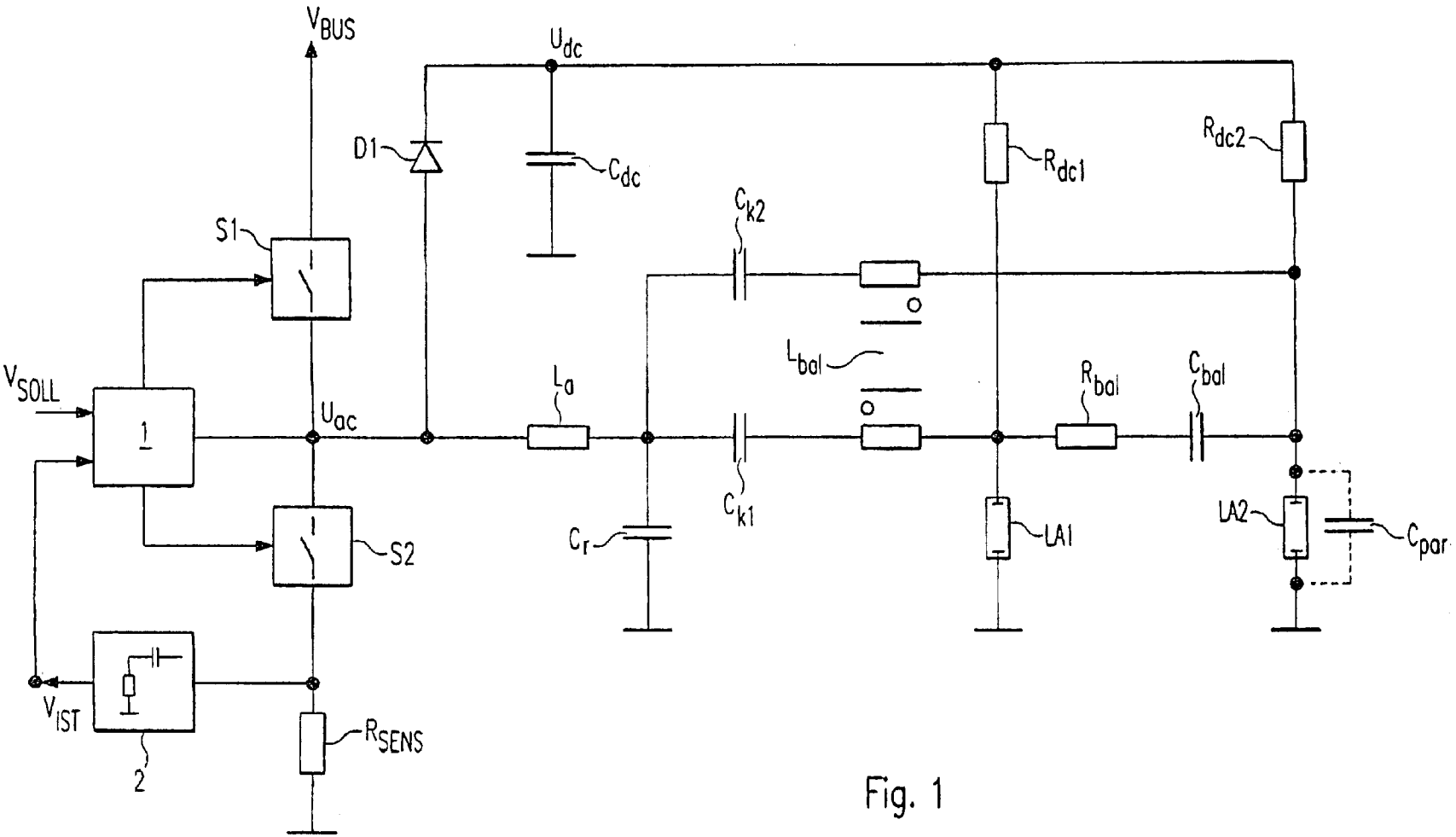
FIG. 1 is an exemplary embodiment of a circuitry arrangement in accordance with the invention, for a two-lamp lamp system.
Figure 4:
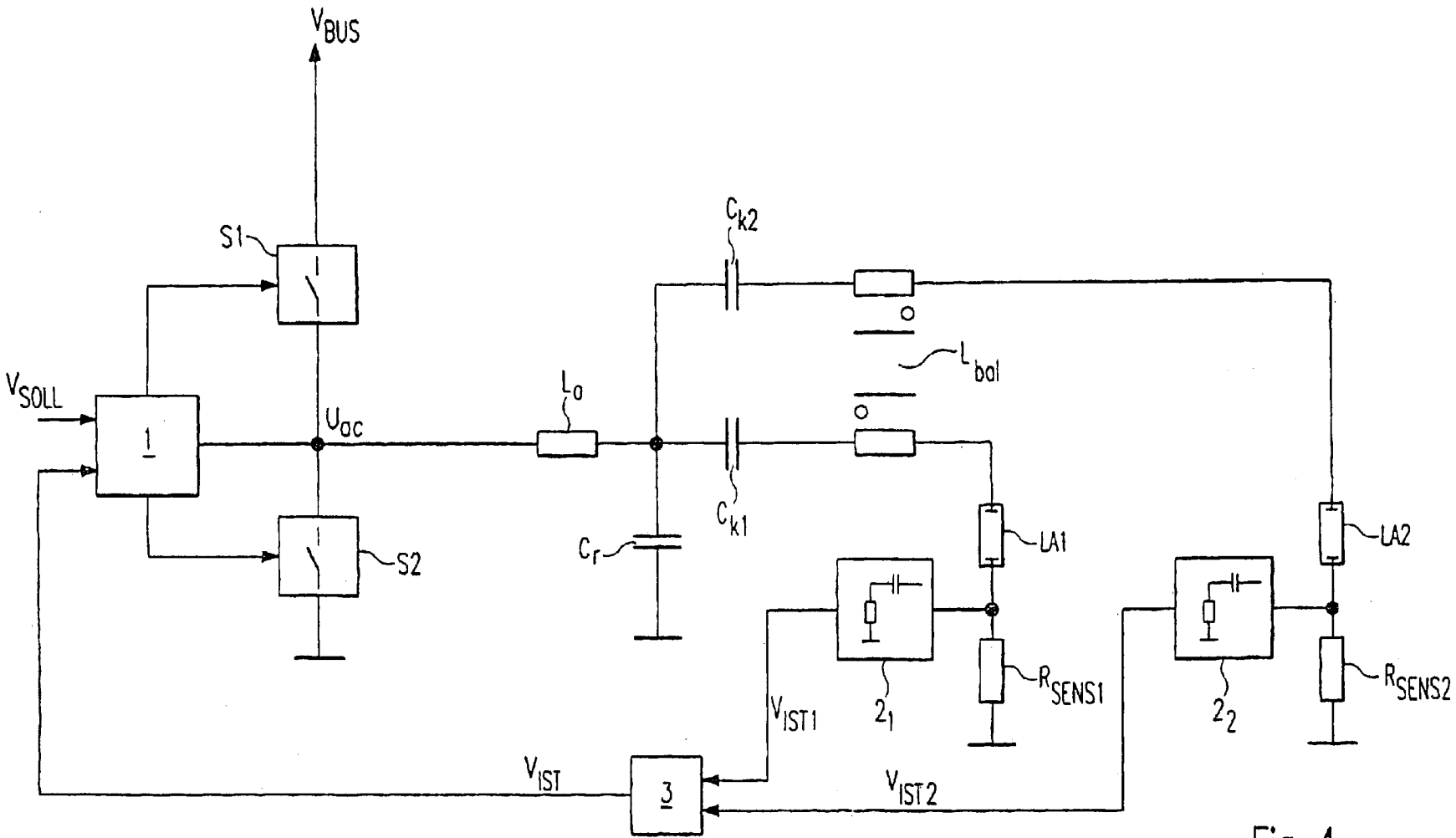
FIG. 4 is a known circuitry arrangement of a two-lamp lamp system.

The circuitry arrangement illustrated in FIG. 1 resembles in its basic structure the known circuit illustrated in FIG. 4. Again, for the operation of the two gas discharge lamps LA1 and LA2, there is provided solely a single inverter consisting of two controllable switches S1 and S2. The switches S1 and S2, arranged in a half-bridge arrangement, are fed with a d.c. voltage $V_{BUS}$ and generate through alternating opening and closing a high frequency a.c. voltage $U_{ac}$ which is delivered to the load circuit. The load circuit contains the series resonant circuit of the inductance $L_a$ and the capacitance $C_r$, to the middle point of which the two lamps LA1 and LA2 are connected via two coupling capacitors $C_{k1}$ and $C_{k2}$. Again, a balancing transformer $L_{bal}$ is connected upstream of the lamps LA1 and LA2.

The d.c. current supply lines in accordance with the invention are connected in each case to a point between the lamp LA1 or LA2 and the output side of the corresponding winding of the balancing transformer $L_{bal}$. They contain in each case a resistance $R_{dc1}$ or $R_{dc2}$ connected in series to the corresponding lamp LA1 or LA2, and are connected on the input side to a common d.c. voltage source. The resistance values for the two resistances $R_{dc1}$ and $R_{dc2}$ are identical. The d.c. voltage source is, in the illustrated example, formed by means of a diode D1 connected to the output of the inverter and a capacitor $C_{dc}$ connected with earth (ground) as a low-pass filter, which forms from of the high frequency a.c. voltage $U_{ac}$ a smoothed d.c. voltage $U_{dc}$.

The d.c. voltage $I_{dc1}$ delivered to the first lamp LA1 can then be calculated as follows:

$$I_{dc1} = \frac{U_{dc}}{R_{dc1} + R_{arc1}}$$

whereby $R_{arc1}$ is the resistance of the gas discharge lamp LA1. The d.c. current delivered to the second lamp LA2 is provided in analogous manner. Thereby, the two resistances $R_{dc1}$ and $R_{dc2}$ are so constituted that the additional d.c. current corresponds approximately to the half of the nominal 1% current at 25° C. to 35° C.

The obtaining of the d.c. voltage $U_{dc}$ from the a.c. voltage $U_{ac}$ of the inverter has the further advantage that after switching off of the inverter also the d.c. current delivered to the lamps LA1 and LA2 is deactivated, so that both lamps LA1, LA2 are reliably switched off. However, there exists also the possibility to employ a d.c. voltage source separate from the inverter. The d.c. current delivered to the lamps LA1, LA2 furthermore prevents the appearance of so-called running layers.

The balancing effect of the transformer $L_{bal}$ functions however, only up to a certain level of dimming. At brightness values below this level of dimming the lamp current is so small that capacitive currents can arise which are greater than the lamp currents themselves. These capacitive currents can, for example, arise in that the lines to the lamps are laid unsymmetrically, through which—as is schematically illustrated for the second lamp LA2—additional wiring capacitances $C_{par}$ and therewith capacitive currents $I_{par}$ appear. If these capacitive currents $I_{par}$ are greater than the lamp currents, the balancing transformer $L_{bal}$ reacts in a manner in that the unsymmetry is increased. The lamp LA1 which does not have the additional wiring capacitance then has delivered thereto an additional effective current $I_{arc1}$ which can be estimated in the following manner:

$$I_{arc1} \approx (I_{arc2}^2 + I_{par}^2)^{1/2}$$

In order to counter this, the balancing effect of the transformer $L_{bal}$ should be reduced for lesser lamp currents without the d.c. voltage sources being influenced by this. This is achieved in that the two output side terminals of the windings of the balancing transformer $L_{bal}$ are connected with one another by means of a frequency-dependent impedance, which in the present example consists of a series circuit of a resistance $R_{bal}$ and capacitor $C_{bal}$. This connection allows a certain compensation of small asymmetries. The reduction of the balancing effect acts, however, only on the a.c. current components of the lamp voltage, that is only on that part which at small dimming levels is responsible for the capacitive currents.

Figure 2:
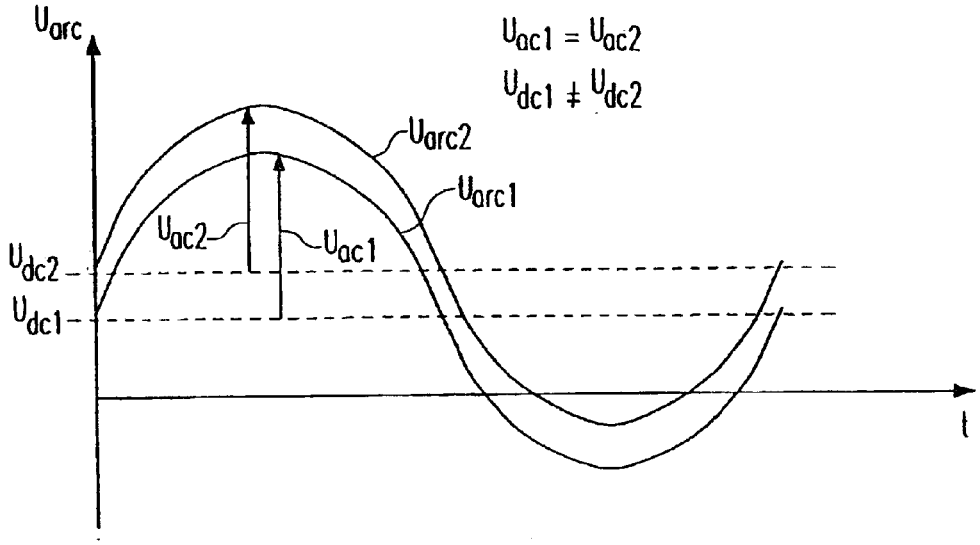
FIG. 2 is an illustration of the effect of the d.c. supply lines in accordance with the invention.
Figure 5:
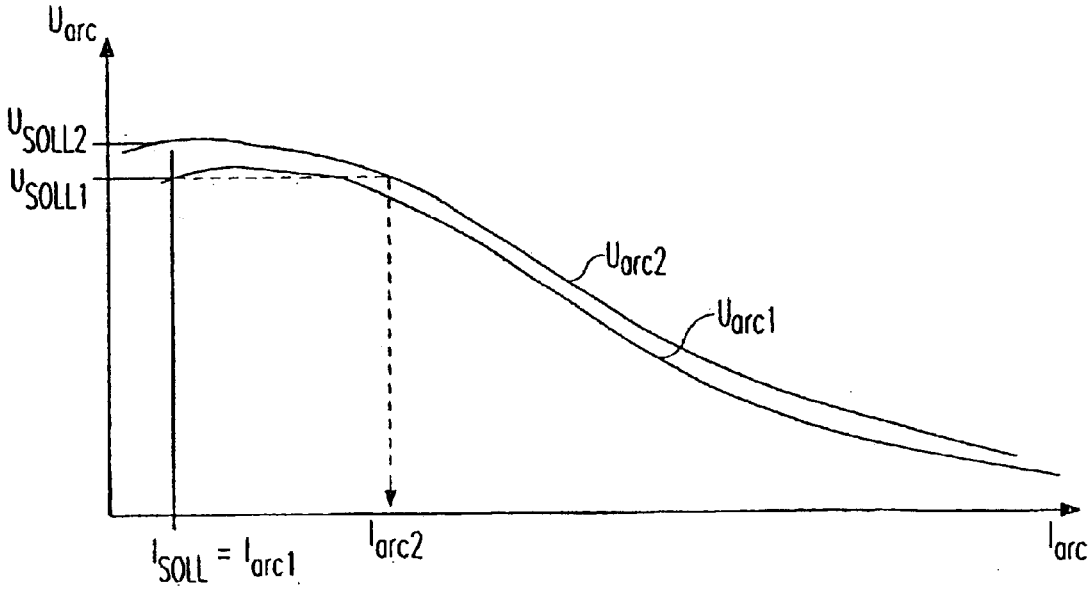
FIG. 5 is an illustration of the effects occurring with lamps having different characteristic lines.

The effect of the circuit in accordance with the invention is schematically illustrated in FIG. 2. The graph illustrated here thereby shows the lamp voltage $U_{arc1}$ and $U_{arc2}$ applied to the lamps LA1 and LA2 and changing with time. Although there is delivered to the two lamps, as before, the same a.c. voltage $U_{ac1}$ and $U_{ac2}$, since they are now, however, decoupled in terms of d.c. current, they can take on different d.c. voltage components $U_{dc1}$ and $U_{dc2}$. As a consequence of this, each lamp can take on exactly the voltage which must be built up for the predetermined brightness value or lamp current. Through this the possibility is provided to control both lamps by means of a single inverter and nonetheless to operate both with the desired brightness.

Since, beyond this, the danger of an accidental extinguishing of one of the lamps LA1 and LA2 no longer arises, it is no longer necessary to provide for each lamp its own detection circuit, as is the case with the circuitry arrangement illustrated in FIG. 4. Instead of this, as illustrated in FIG. 1, only a single detection circuit 2, for example in the form of a low-pass filter, can be employed, which detects the voltage dropping via a measuring resistor $R_{SENS}$ arranged at the base point of the half-bridge circuit and correspondingly generates an actual value $V_{IST}$. This actual value corresponds now to the sum of the effective powers of both gas discharge lamps LA1 and LA2. The actual value $V_{IST}$ generated by detection circuit 2 is delivered to the control circuit 1, which after a comparison of the actual value $V_{IST}$ with a desired value $V_{SOLL}$ corresponding to the desired brightness, controls the two switches S1 and S2 of the inverter.

Figure 3:
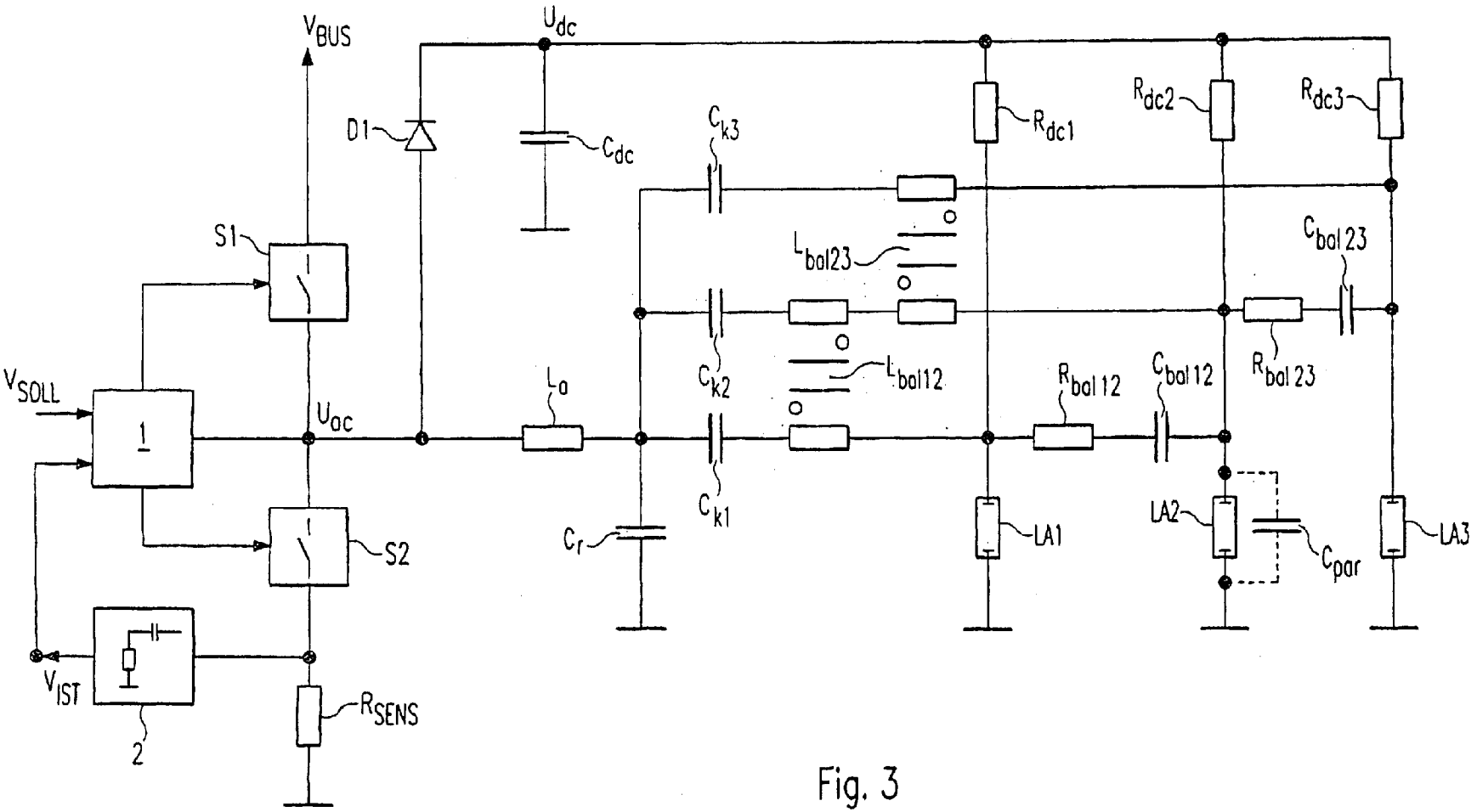
FIG. 3 is an exemplary embodiment of a circuitry arrangement in accordance with the invention for a three-lamp lamp system.

A further advantage of the circuitry arrangement in accordance with the invention consists also in that this can be extended without difficulties to more than two lamps. This is illustrated in FIG. 3, which illustrates the extension of the system to three discharge lamps LA1, LA2 and LA3. The extension consists only in that now a plurality of balancing transformers $L_{bal12}$ and $L_{bal23}$ are employed, which balance in each case the current of two lamps LA1 and LA2 or LA2 and LA3. Again, the output side terminals of the balancing transformers $L_{bal12}$ and $L_{bal23}$ are connected with one another via the above-described series circuit of a resistance $R_{bal12}$ or $R_{bal23}$ and a capacitance $C_{bal12}$ or $C_{bal23}$, in order to effect the decoupling of the d.c. current components. An extension of the system to n gas discharge lamps then consists only in that (n−1) balancing transformers are employed, which balance in each case the currents of two lamps.

In particular, with the extension to more than two gas discharge lamps the advantage of the circuitry arrangement in accordance with the invention shows itself, since as before the employment of a single detection circuit 2 is sufficient, through which a significant simplification of the circuitry is achieved.

What is claimed is:

1. Circuitry arrangement for the operation of n gas discharge lamps, n being a whole number greater than 1, with a single inverter, fed with d.c. voltage, for the generation of an a.c. voltage alterable in its frequency, which is delivered to a load circuit arranged at an output of the inverter, the load circuit comprising:

a series resonant circuit of an inductance and a capacitance; and n gas discharge lamps connected to a common node point between the inductance and the capacitance, which lamps are connected in parallel to one another, wherein the load circuit further has for each gas discharge lamp at least one d.c. current supply line via which there is delivered to each gas discharge lamp a d.c. current, and wherein the circuitry arrangement comprises a detection circuit which detects a sum of effective powers of the gas discharge lamps arranged in the load circuit and generates a corresponding actual value, and a control circuit which controls the inverter on the basis of a comparison between a desired value and the actual value generated by the detection circuit.

2. Circuitry arrangement according to claim 1, wherein the circuitry arrangement further comprises balancing transformers for balancing currents in each case of two gas discharge lamps.

3. Circuitry arrangement according to claim 2, wherein each d.c. current supply line is in each case connected between an output side terminal of a corresponding winding of a corresponding balancing transformer and a corresponding gas discharge lamp.

4. Circuitry arrangement according to any of claims 1 to 3, wherein each d.c. current supply line has a resistance connected in series and wherein at their input side terminal there is applied a common supply voltage, each resistance being of a same resistance value.

5. Circuitry arrangement according to claim 4, wherein the common supply voltage is formed by means of a diode connected to the output of the inverter.

6. Circuitry arrangement according to claim 5, wherein a low pass filter is arranged between the diode and the at least one d.c. current supply line.

7. Circuitry arrangement according to claim 2, wherein output side terminals of windings of at least one balancing transformer are connected with one another in each case by means of a series circuit of a capacitor and a resistance.

8. Circuitry arrangement according to any of claims 1 to 3 or 7, wherein the inverter is formed by means of two switches arranged in a half-bridge arrangement.

9. Circuitry arrangement according to claim 8, wherein the detection circuit detects a voltage dropped via a resistance arranged at a base point of the half-bridge arrangement.

* * * * *